United States Patent [19]

Lang et al.

[11] Patent Number: 4,950,308

[45] Date of Patent: Aug. 21, 1990

[54] APPARATUS FOR PRODUCING A PRODUCT GAS FROM A FINELY-DIVIDED CARBON-BEARING SUBSTANCE

[75] Inventors: Michael Lang, Mülheim/Ruhr; Gerhard Wilmer, Hattingen; Michael Kühn, Lünen, all of Fed. Rep. of Germany

[73] Assignee: Krupp Koppers GmbH, Essen, Fed. Rep. of Germany

[21] Appl. No.: 379,803

[22] Filed: Jul. 13, 1989

[30] Foreign Application Priority Data

Jul. 16, 1988 [DE] Fed. Rep. of Germany ..... 3824233

[51] Int. Cl.[5] ..... C10J 3/86; C10J 3/76

[52] U.S. Cl. ..... 48/62 R; 48/67; 48/69; 48/77

[58] Field of Search ..... 48/62 R, 63, 64, 67, 48/69, 73, 77, DIG. 2, 202; 55/269; 122/6 A, 7 R; 165/146, 147, 903

[56] References Cited

U.S. PATENT DOCUMENTS

| | | | |
|---|---|---|---|
| 2,344,588 | 3/1944 | Blaurelt | 165/146 |
| 2,589,730 | 3/1952 | Puttkey | 165/146 |
| 3,825,063 | 7/1974 | Corvans | 165/146 |
| 4,013,427 | 3/1977 | Gernhardt et al. | 48/67 |
| 4,478,606 | 10/1984 | Dorling et al. | 122/7 R |
| 4,586,565 | 5/1986 | Hallstrom et al. | 165/146 |
| 4,610,697 | 9/1986 | Darling et al. | 48/77 |

FOREIGN PATENT DOCUMENTS

| | | | |
|---|---|---|---|
| 0115094 | 8/1984 | European Pat. Off. . | |
| 1250094 | 11/1986 | Japan | 48/67 |

*Primary Examiner*—Peter Kratz

*Attorney, Agent, or Firm*—Michael J. Striker

[57] ABSTRACT

The apparatus for producing a product gas from a fine-grained carbon-bearing substance during a high-pressure gasification comprises a vertical gasifier and radiative cooling device, a vertical convective cooling device through which a flow occurs from top to bottom and a connecting pipe between a head of the gasifier and radiative cooling device and a head of the convective cooling device. The gasifier and radiative cooling device comprises a pipe-like shaft, a lower cinder outlet and an upper conical connecting piece for the connecting pipe. The shaft is constructed as an equal speed flow duct, which is not equipped for feeding a foreign cooling means, but is designed so that solidification of the accompanying cinders travelling with the product gas occurs by radiative cooling.

12 Claims, 3 Drawing Sheets

APPARATUS FOR PRODUCING A PRODUCT GAS FROM A FINELY-DIVIDED CARBON-BEARING SUBSTANCE

BACKGROUND OF THE INVENTION

Our invention relates to a process for making a product gas from a finely-divided carbon-bearing substance and, more particularly, from a finely-divided to powdery coal.

An apparatus for producing a product gas from a finely divided carbon-bearing substance, especially from a finely-divided to powdery coal, in the course of a high-pressure gasification comprising a vertical gasifier and radiative cooling device through which a flow occurs from bottom to top, a vertical convective cooling device through which a flow occurs from top to bottom and a connecting pipe between the head of the gasifier and radiative cooling device and the head of the convective cooling device. The gasifier and radiative cooling device has a shaft, which is circular in horizontal cross section and formed like a pipe, a lower cinder outlet and an upper conical connecting piece for the connecting pipe and is set up for cooling the fluidized cinder particles traveling with the product gas until they are solid and the convective cooling device is equipped with a lower outlet for the product gas and accompanying cinder particles. The product gas is a crude product and is subsequently purified. It comprises carbon monooxide and water and is used as a synthetic gas for making hydrocarbons, such as a heating gas, particularly for a gas turbine of a gas and steam turbine power plant, or as a reducing gas for metallurgical purposes. In regard to the chemistry and physics of high-pressure gasification, carbon high-pressure gasification is generally taught in the technical literature. The product gas allows the gasification step to proceed at a temperature of from 1300° to 1700° C. The appropriate devices are provided for the feed, transport and delivery of the flow rates of the species participating in the process.

In the known apparatus as described in European Pat. No. 0 115 094, on which our invention has been based, the shaft is provided with a quenching device for the direct feed of a foreign cooling agent (as steam, cooled product gas and the like) in connection with the gasification step. Here the product gas is cooled to such an extent that the cinder particles accompanying the product gas are almost completely solidified and no longer adhere to each other. In the radiative cooling portion a foreign cooling means is supplied indirectly. The register for the superheated steam is located there. After that the product gas enters into the connecting pipe. The known features are open to criticism: The problems, which occur in operation of the plant or apparatus, are on the one hand gas dynamic in nature and thus subject to the Laws of Aerodynamics and also the Laws of Thermodynamics. Also chemical kinetics provides an understanding of the process in the flowing gases as well. The aerodynamics and thermodynamics of the flow are controlled by their own boundary conditions and those boundary conditions are not immediately effected by the chemistry in the flow. In the above-described example the physical phenomenon are complex and the operation is barely optimizable and various operating parameters are scarcely adjustable. Disturbances in production losses resulting from energy losses must be taken into the bargin, i.e. considered. Besides the conveying action of the gas flow in regard to the accompanying cinder particles along the path of the flow of product gas from the gasification step to the outlet of the convective cooling device is by no means guaranteed.

SUMMARY OF THE INVENTION

Accordingly, it is an object of my invention to provide an apparatus for producing a product gas from a finely-divided carbon-bearing substance, whose operation is possible with substantially improved operating efficiency and reduced energy losses.

In keeping with this object and with others which will become apparent hereinafter, the shaft is constructed as an equal speed flow duct in regard to the flow of product gas, which is free of devices for the direct and/or indirect feed of foreign gases, and the equal speed flow duct which acts as a radiant cooling device for the product gas is so designed that the solidification of the accompanying cinder particles occurs by radiative cooling alone. The expression "equal speed flow duct" indicates a flow duct in the scope of the invention, which guarantees that the flow speed of the product gas adjusted by the flow cross section is sufficiently constant over the length of the equal speed flow duct and in each case does not drop so that the carrying capacity for the cinder particles is impaired and an agglomeration of the cinder particles in eddy zones is avoided. The equal speed flow duct is, as in steam producing vessels, constructed as a pipe and indeed with as smooth as possible an interior wall.

Our invention is based on the knowledge that in the known apparatus for gasification the aerodynamic and the thermodynamic considerations are not separable and depend on each other. The aerodynamic and thermodynamic relations forms a complex set of interrelated relationships, which can scarcely be decoupled even with the means available to modern measurement and control engineering in operation and may be optimized and adjusted to different operation conditions. In contrast the aerodynamics and thermodynamics according to our invention are largely separated. The thermodynamics is no longer set up according to the cost of the aerodynamics and the reverse. Consequently an optimized delivery of product can occur and the operating conditions can be controlled with the help of modern measurement and control technology. The reaction kinetics is not disturbed and even improved. Basically it is known to use a quenching device in the radiative cooling step in an apparatus for producing a product gas from a finely-divided carbon-bearing substance (VGB Kraftwerkstechnik 59, 1979, S. 565, Bild 3 or VGB Power Plant Engineering, 59, 1979, p. 565, FIG. 3). In this known apparatus the quenching device is located at the entrance of a device functioning as a vaporizing device, whose cross section is considerably larger than the cross section of the shaft of the radiative cooling device, which impairs the stability of the process and requires special devices in this zone in relation to the control of the fly ash balance.

According to the temperature difference between the gasification step and the product gas at the entrance to the connecting pipe, the equal speed flow duct can be circular cylindrical in shape over its entire length and can have a constant cross section. It is also possible to adjust the cross section of the equal speed flow duct to the reduced volume which occurs on cooling by radiation. In this connection one embodiment of our invention is characterized by the following: The equal speed-flow duct is constructed as a cylindrical flow duct and is designed for radiative cooling of the product gas up to about 1000° C. at the entrance to the connecting pipe and in the vicinity of the nozzle-shaped connector piece for the connecting pipe a quenching device is located for the introduction of a foreign cooling agent and a connecting portion of the connecting pipe is set up as a direct cooling segment and designed for cooling of the product gas to about 700° C. In another embodiment of our invention the equal speed flow duct has a decreasing, circular cross section in the direction of flow according to the volume reduction required by cooling and is designed as a radiative cooling device for cooling the product gas to about 700° C. The described embodiments do not exclude the possibility of arranging a quenching device at the end of the connecting pipe and/or at the beginning of the convective cooling device.

According to one embodiment of our invention in both cases the flow duct starts directly above the combustion chamber used in the gasification step. In the scope of our invention the equal speed flow duct has radial partitions, which are thermodynamically integrated in the radiative cooling process and do not impair the previously defined equal speed distribution on aerodynamic grounds. Also in the scope of our invention a superheated steam generator can be used. In another embodiment the indirect feeding of the foreign cooling means is possible however our invention also teaches that the superheated steam generator can be located in the upper portion of the convective cooling apparatus.

In the apparatus according to our invention the central flow speed of the product gas is set up basically so that the cinder particles can precipitate from the flow at no position along the flow path. Tests have shown that the apparatus can be designed so that the gasifier and radiative cooling device is set up for a flow speed of product gas of less than 1 m/sec. To control problems produced by deposits, the convective cooling device can be equipped with rapping cleaning devices. The connecting piece can be set up without compensators and without compensators at the gasifier and radiative cooling device and/or at the convective cooling device and the convective cooling device is mounted on its base with a compensating device for thermal expansion interposed.

The complete elimination of a mixture cooling or quenching device in the gasifier and radiative cooling device is possible which use the available temperature difference for steam production exclusively. Because of that in the apparatus according to our invention in comparison to the known apparatus as described in EP 0 115 094 the energy loss is reduced to about 2 percentage points, which for example when integrating our invention with a gas-steam turbine power plant produces an improvement in efficiency of the power plant for power production of about 2 percentage points.

DETAILED DESCRIPTION OF THE DRAWING

Figure 1:
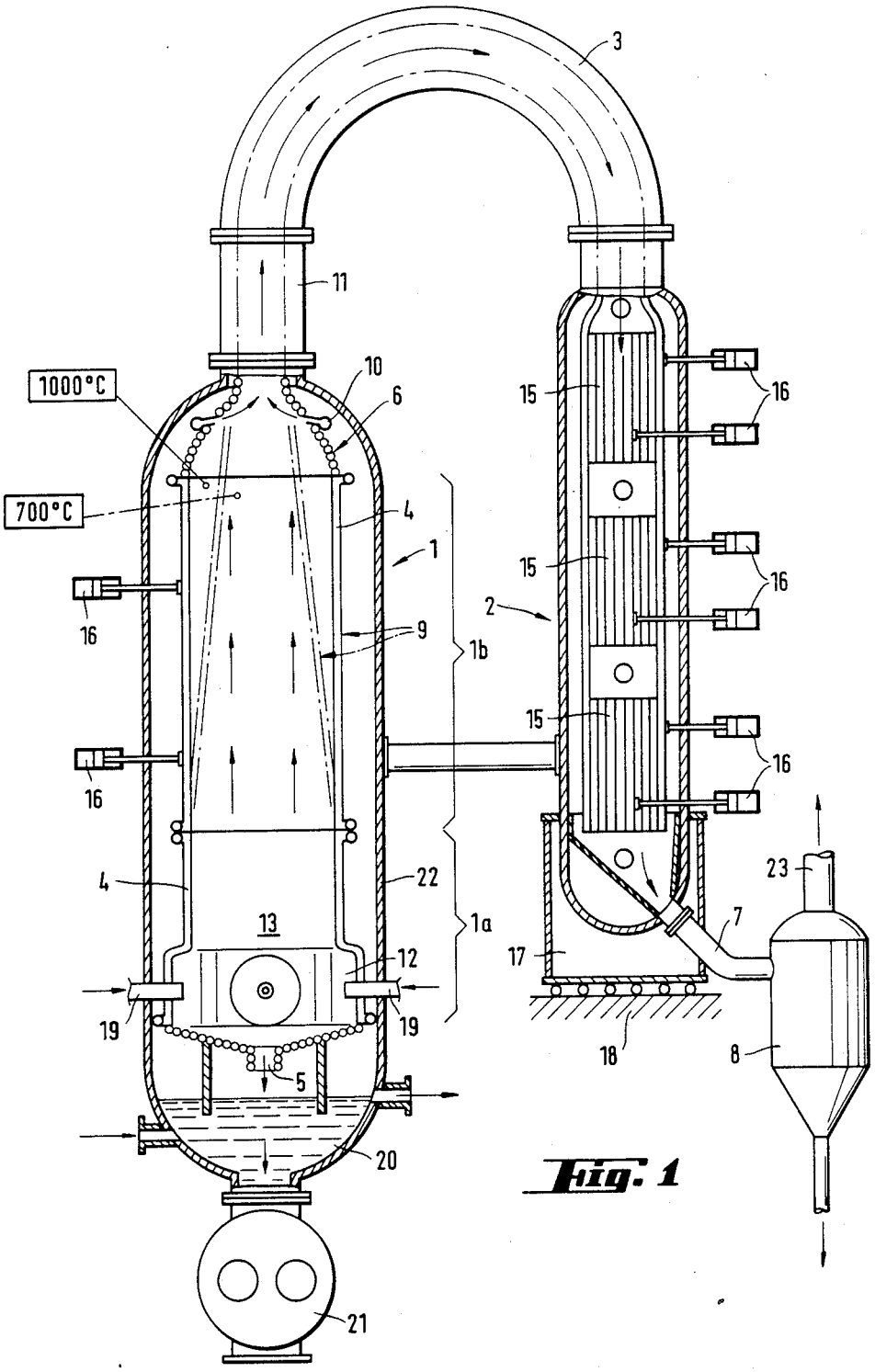
Figure 2:
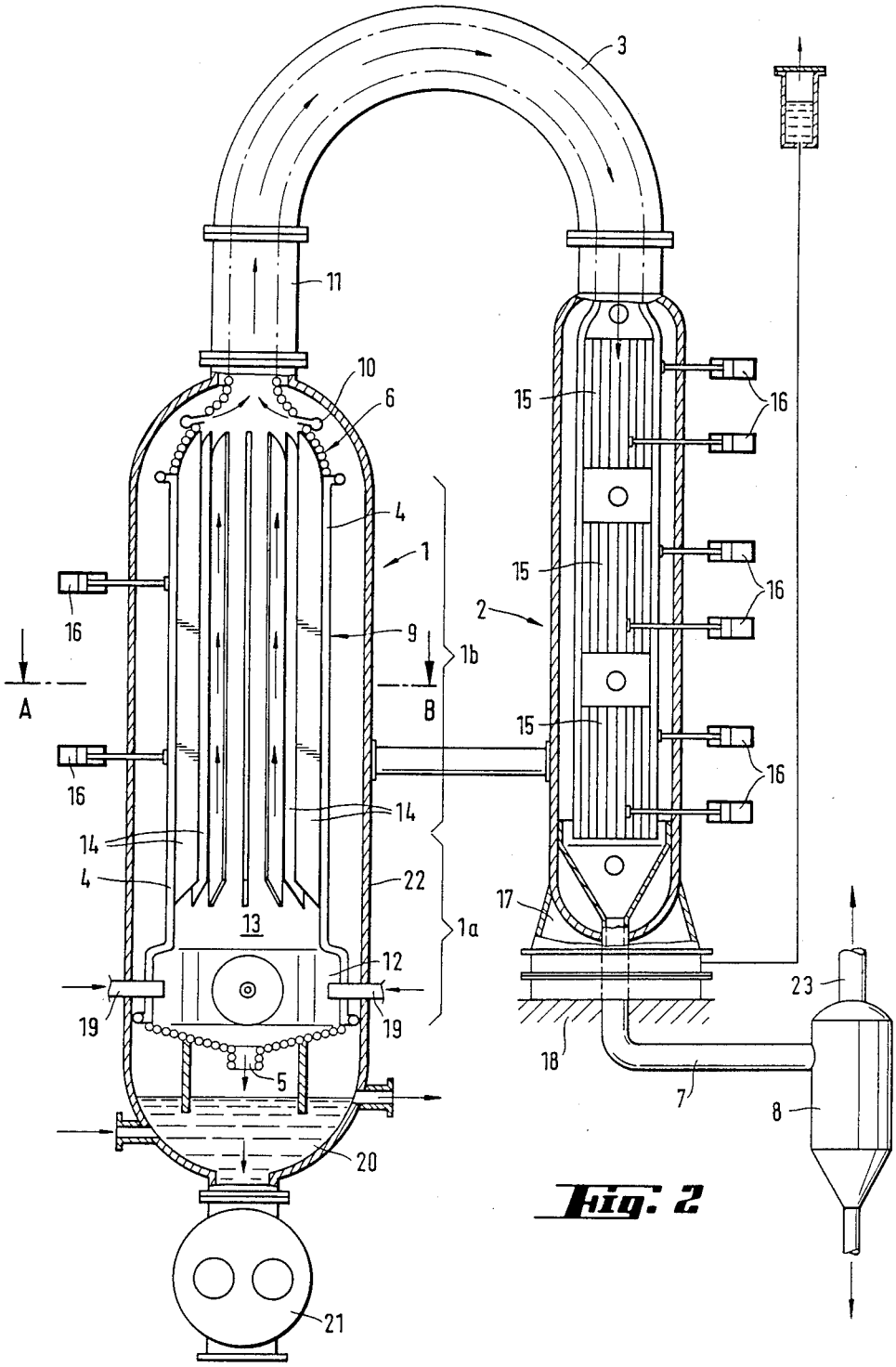
Figure 3:
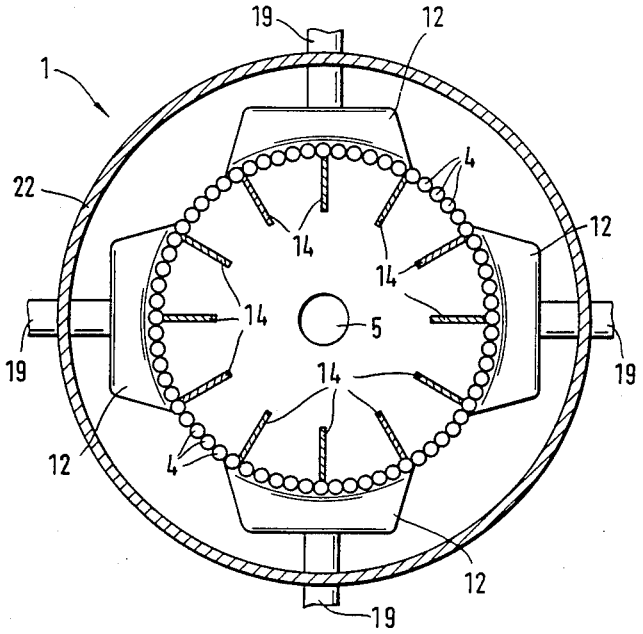

The objects, features and advantages of our invention will be made more apparent from the following detailed description, reference being made to the accompanying drawing in which:

FIG. 1 is a side elevational view of an apparatus for performing the process for generating a product gas from a finely-divided carbon-bearing substance according to our invention, FIG. 2 is a side elevational view of another embodiment of the apparatus shown in FIG. 1, and FIG. 3 is a cross sectional view taken along the section line III—III of FIG. 2.

DETAILED DESCRIPTION OF THE INVENTION

The apparatus shown in the drawing is designed and equipped for producing a product gas from a finely-divided carbon-bearing substance, especially from a finely-divided coal in the course of a high-pressure gasification. This apparatus basically comprises a vertical gasifier and radiative cooling device 1, through which gas flows from bottom to top, as indicated with the arrows in FIGS. 1 and 2, a vertical convective cooling device 2, through which the product gas passes from top to bottom, and a cooled connecting pipe 3 between the head or upper portion of the gasifier and radiative cooling device 1 and the head of the convective cooling device 2.

The gasifier and radiative cooling device 1 has a circular cross-sectioned shaft comprising a pipe 4, a lower fluid cinder outlet 5 and an upper nozzle-shaped connecting piece 6 for the connecting pipe 3. It is equipped with cooling means for cooling the product gas sufficiently with the accompanying fluidized cinder particles. The gasifier and radiative cooling device 2 is equipped with a lower outlet 7 for the product gas and cinder particles travelling along with it. A cyclone 8 or filter is connected.

The shaft is constructed as a equal speed flow duct 9 in regard to the flow of the product gas. It is free of devices for the direct and/or indirect feed of foreign cooling means. The uniform speed flow duct 9 is equipped as a radiant cooler in regard to the cooling of the product gas and set up so that alone the adequate reinforcement of the carried-along cinder particles occurs because of radiative cooling.

The embodiment shown in FIG. 1 makes clear that the equal speed flow duct 9 has a circular horizontal cross section and acts as a radiant cooler for cooling of product gas to about 1000° C. at the entrance of the connecting pipe 3. This temperature was indicated with dashed lines in the example drawn with solid lines. In the vicinity of the nozzle shaped connecting piece 6 for the connecting pipe 3 and/or directly connected to that a quenching device 10 is provided for direct guiding of the foreign cooling means. Besides a connector part 11 for the connecting pipe 3 is provided as a directly cooled segment and is designed for cooling product gas to about 700° C. The parts shown with dot-dashed lines are free of the quenching device 10. The equal speed flow duct 9 has a cross section decreasing in the flow direction according to the volume reduction of the product gas required by cooling. In the drawing this delivery pipe is illustrated with a linearly-decreasing cross section and is shown exaggerated. More exactly this reduction follows an exponential function. This dot-dashed equal speed flow duct 9 is designed as a radiative cooling device for the cooling a product gas to about 700° C., as was indicated in FIG. 1. In both cases the equal speed flow duct 9 begins directly above the combustion chamber 12 of the gasifier 13, which is discernable especially in FIG. 3, which show a cross section in the direction indicted by the arrows. In the embodiment according to FIG. 2 the equal speed-flow duct has a plurality of additional radial partitions 14, which are integrated thermodynamically in the radiative cooler. Also one sees this in FIG. 3. Besides in this embodiment a steam superheater 15 is always provided, it is located in the upper portion of the convective cooling device 2.

The particular value of the flow speed in the plant according to out invention is basically arbitrary. However, it should be chosen as small as possible to generate only a very fine grained cinder. Thus the equal speed flow duct 9 may be equipped for a flow speed of product gas of less than 1 m/sec. Since the cross section of the connecting pipe 3 is substantially reduced, the cinder particles can be transported from the gasifier and radiative cooling device 1 into the convective cooling device 2.

Rapping cleaning devices 16 are indicated both in FIG. 1 and also in FIG. 2, which engage outside the shaft, which forms the flow speed flow duct 9. Both in the embodiment according to FIG. 1 and also in the embodiment according to FIG. 2 the connecting pipe 3 is constructed compensation-free and connected compensation-free in the gasifier and radiative cooling device 1 and/or to the convective cooling device 2. The convective cooling device 2, which functions thermally or hydraulically, is mounted on its base 18 with a thermal expansion compensating device 17 interposed. In particular a plant according to our invention and its operation is described in the following:

The finely-divided fuel, chiefly 75% smaller than 0.09 mm grain size, are brought through the burner 19 of the combustion chamber 12 in a mixture with an oxygen-containing gasifying means(oxygen to air) with addition of process steam in the gasifier 13, where the fuel in a gas which contains substantially CO and $H_2$ is converted by partial combustion. The gasifier 13 is formed by a lower portion of the pipe wall construction of the equal speed flow duct 9 and/or a connected device and with a corrosion-resistant coating with a certain coefficient of heat transfer. The radiating portion 1*b* and the convective cooling apparatus together make a cooling system in which high pressure steam is used. In contrast the gasifying portion 1*a* can contain a cooling medium, which operates with a lower temperature than corresponds to high pressure steam. The cinder issuing from the device at 5 is solidified in a water bath 20. The cinder arrives at the grinder or crusher 21, which breaks the cinder to a grain size finer than 25 mm. The broken cinder is discharged from the system. The level in the water bath is maintained by the feed and withdrawal of cinder cooling water. The pipe wall construction is mounted in a cylindrical pressurized jacket in such a way that the system pressure of the cooling system determines the temperature with which the pressurized jacket 22 is loaded. The gasifier 13 and the equal speed flow duct 9 have separate cooling systems. The hot gas produced in the gasifier 13 carrying pasty to fluidized cinder particles leaves the gasifier 13 from its top. In the equal speed flow duct 9 the crude gas and the particles travelling with it are cooled so that the particles travelling with it are practically solid and on entrance into the direct cooling segment 11 and inside same no agglomeration of the particles occurs. The cross section of the quenching device 10 continues smoothly in a series of intermediate cross sections, whereby the speed correspondingly increases. In the path of the subsequently climbing gas the carrying capacity of the gas flow for particles lies in the direction of increasing with grain size or diameter. Also the flow cross sections are formed in the equal speed flow duct 9 so that the carrying capacity of the gas for the particles lies in the direction of increasing limiting grain size or diameter. Also the connecting pipe 3 and the convective cooling device 2 are constructed like the pressurized jacket with a pipe wall structure. The cooled product gas leaves the connective cooling device 2 through the outlet 7, the cinder particles being separated in and removed by the cyclone 8. The gas leaves the cyclone 8 through the outlet 23.

It will be understood that each of the elements described above, or two or more together, may also find a useful application in other types of constructions differing from the types described above.

While the invention has been illustrated and described as embodied in an apparatus for producing a product gas from a finely-divided carbon-bearing substance, it is not intended to be limited to the details shown, since various modifications and structural changes may be made without departing in any wa from the spirit of the present invention.

Without further analysis, the foregoing will so fully reveal the gist of the present invention that others can, by applying current knowledge, readily adapt it for various applications without omitting features that, from the standpoint of the prior art, fairly constitute essential characteristics of the generic or specific aspects of this invention.

What is claimed as new and desired to be protected by Letters Patent is set forth in the appended claims.

1. In an apparatus for producing a flow including a product gas and accompanying cinder particles from a finely-divided carbon bearing substance in the course of a high-pressure gasification comprising:

a vertical gasifier and radiative cooling device having a head through which said flow occurs in a flow direction from bottom to top, a vertical convective cooling device also having a head through which said flow occurs from top to bottom, and a cooled connecting pipe between said head of said gasifier and radiative cooling device and said head of said convective cooling device, said gasifier and radiative cooling device comprising a shaft which is circular in horizontal cross section and formed like a pipe, a lower cinder outlet and an upper conical connecting piece for said connecting pipe, and said gasifier and radiative cooling device being formed for cooling of said product gas as said accompanying fluidized cinder particles traveling with said product gas are undergoing solidification and said convective cooling device is provided with a lower outlet for said product gas and said accompanying cinder particles, the improvement wherein said shaft is constructed relative to said flow of said product gas as an equal speed flow duct, which is free of devices for direct and/or indirect feed of a foreign cooling means and said equal speed flow duct is designed in regard to cooling of said product gas, so that solidification of said accompanying cinder particles occurs by radiative cooling.

2. The improvement according to claim 1 wherein said vertical gasifier and radiative cooling device further comprises a nozzle-like connecting piece for said connecting pipe and a quenching device for feeding said foreign cooling means located in the vicinity of said nozzle-like connecting piece for said connecting pipe, said connecting pipe being provided with an entrance for said flow, said equal speed flow duct being cylindrical and designed for radiative cooling of said product gas until at about 1000° C. at said entrance to said connecting pipe and said connecting pipe having a connector part provided as a direct cooling segment designed for cooling said product gas to about 700° C.

3. The improvement according to claim 1 wherein said equal speed flow duct has a cross section decreasing in said flow direction of said product gas according to a volume reduction required by cooling of said product gas and is designed for radiative cooling of said product gas to about 700° C.

4. The improvement according to claim 1, wherein said vertical gasifier has a plurality of combustion chambers, said equal speed flow duct beginning directly above said combustion chambers of said gasifier.

5. The improvement according to claim 1 wherein said equal speed flow duct has a plurality of radial partitions which are designed for use in said radiative cooling.

6. The improvement according to claim 1 further comprising a steam superheater located in an upper portion of said convective cooling device.

7. The improvement according to claim 1 wherein said equal speed flow duct is formed to provide a flow speed of said product gas of less than 1 m/s.

8. The improvement according to claim 1 further comprising a rapping cleaning device which engages exteriorly on said equal speed flow duct.

9. The improvement according to claim 1 wherein said convective cooling device is provided with a rapping cleaning device.

10. The improvement according to claim 1 wherein said gasifier and radiative cooling device has a gasifying portion having a cooling medium and a radiating portion having another cooling medium, said gasifying portion being separated from said radiating portion and an operating pressure and/or a working temperature of said cooling mediums differing in said gasifying portion and said radiating portion.

11. The improvement according to claim 1 further comprising a base and said convective cooling device is mounted on said base with interposition of a thermal expansion compensating device.

12. The improvement according to claim 1 wherein said connecting pipe is formed without compensators and is connected without compensators in said gasifying and radiative cooling device.

* * * * *